US008656673B2

(12) United States Patent
Yang et al.

(10) Patent No.: US 8,656,673 B2
(45) Date of Patent: Feb. 25, 2014

(54) WALL STRUCTURE FOR BUILDING A LIQUEFIED GAS STORAGE TANK

(75) Inventors: Young Myung Yang, Gyeonggi-do (KR); Ihn Soo Yoon, Incheon-si (KR); Heung Seok Seo, Gyeonggi-do (KR); Young Kyun Kim, Seoul-si (KR)

(73) Assignee: Korea Gas Corporation, Gyeonggi-Do (KR)

( * ) Notice: Subject to any disclaimer, the term of this patent is extended or adjusted under 35 U.S.C. 154(b) by 521 days.

(21) Appl. No.: 12/623,640

(22) Filed: Nov. 23, 2009

(65) Prior Publication Data

US 2011/0099930 A1 May 5, 2011

(30) Foreign Application Priority Data

Nov. 5, 2009 (KR) ..... 10-2009-0106531

(51) Int. Cl.

| | |
|---|---|
| ***E04B 1/04*** | (2006.01) |
| ***E04B 1/16*** | (2006.01) |
| ***E04B 2/40*** | (2006.01) |
| ***E04H 7/18*** | (2006.01) |
| ***E04B 2/68*** | (2006.01) |

(52) U.S. Cl.

CPC .. *E04B 2/40* (2013.01); *E04H 7/18* (2013.01); *E04B 2/68* (2013.01)

USPC ..... 52/383; 52/245; 52/565; 52/569; 52/745.03; 52/745.14

(58) Field of Classification Search

USPC ..... 52/223.4, 223.5, 245, 249, 382, 383, 52/562, 565, 569, 742.14, 745.01, 745.03

See application file for complete search history.

(56) References Cited

U.S. PATENT DOCUMENTS

| | | | | |
|---|---|---|---|---|
| 1,050,130 | A * | 1/1913 | Harvey | 52/583.1 |
| 3,300,943 | A * | 1/1967 | Owens | 52/745.11 |
| 4,006,570 | A * | 2/1977 | Stolz | 52/432 |
| 4,180,951 | A * | 1/1980 | Francioni | 52/100 |
| 5,038,540 | A * | 8/1991 | Krautz | 52/245 |
| 6,401,417 | B1 * | 6/2002 | Leblang | 52/481.1 |
| 7,555,872 | B1 * | 7/2009 | Beach | 52/745.1 |

FOREIGN PATENT DOCUMENTS

| | | |
|---|---|---|
| GB | 2 124 743 | 2/1984 |
| JP | 56-120900 | 9/1981 |
| JP | 2000336969 | 12/2000 |
| JP | 2004106884 | 4/2004 |
| KR | 10-0430862 | 4/2004 |

* cited by examiner

*Primary Examiner* — William Gilbert
(74) *Attorney, Agent, or Firm* — Baker & Hostetler LLP

(57) ABSTRACT

The present disclosure relates to a unit-wall structure for a liquefied gas storage tank on land, which enables rapid and easy construction of a cylindrical wall of the storage tank by stacking a plurality of pre-produced unit-wall structures to overlap one another. The unit-wall structure includes iron rods arranged lengthwise and breadthwise therein, wherein the unit-wall structure has an arc shape so that a plurality of unit-wall structures are stacked to form a cylindrical wall of the storage tank.

16 Claims, 3 Drawing Sheets

WALL STRUCTURE FOR BUILDING A LIQUEFIED GAS STORAGE TANK

CROSS-REFERENCE

This application claims priority from and the benefit of Korean Patent Application No. 10-2009-0106531, filed on Nov. 5, 2009, which is hereby incorporated by reference for all purposes as if fully set forth herein.

TECHNICAL FIELD

The present disclosure relates to a unit-wall structure for a liquefied gas storage tank on land and, more particularly, to a unit-wall structure for a liquefied gas storage tank on land, which enables rapid and easy construction of a cylindrical wall of the storage tank by stacking a plurality of pre-produced unit-wall structures to overlap one another.

BACKGROUND

Generally, a liquefied gas storage tank on land has a substantially cylindrical flat bottom and is used to store liquefied gas for fuels, such as liquefied natural gas (LNG), liquefied petroleum gas, and the like, and other liquefied gases such as liquefied oxygen, liquefied nitrogen, and the like. One example of such a cylindrical liquefied gas storage tank is disclosed in Japanese Patent Laid-open Publication No. Sho 56-120900.

FIG. 1 shows one example of a conventional full-containment type liquefied gas storage tank on land. Referring to FIG. 1, the liquefied gas storage tank includes a cylindrical tank body 3 formed through concrete casting on a foundation 1 and having an approximately dome-shaped cover.

The tank body 3, which is made of concrete, is provided therein with a heat insulating bottom 4 and a heat insulating wall 5, and a vapor barrier 2 is interposed between the tank body 3 and the heat insulating bottom 4 and between the tank body 3 and the heat insulating wall 5. Inside the heat insulating bottom 4 and the heat insulating wall 5, a container 6 is located to contain a cryogenic liquefied gas in a sealed state.

Since the container 6 directly contacts the liquefied gas, it may be made of a low-temperature carbon material or the like, which is capable of enduring cryogenic conditions.

Such a conventional liquefied gas storage tank is generally constructed to have the cylindrical tank body 3 by performing foundation work and repeating a process of pouring concrete into a mould on the foundation 1 to produce one wall having a predetermined height and a process of re-pouring the concrete into the mould to produce another wall of a predetermined height on the one wall after the one wall is completely hardened to have predetermined strength. Accordingly, the conventional liquefied gas storage tank has a problem in that considerable time is consumed for construction thereof.

SUMMARY

The present disclosure is directed to solving the problems of the related art as described above, and one embodiment includes a pre-producible unit-wall structure used for construction of a liquefied gas storage tank on land, which enables rapid and easy construction of a cylindrical wall of the storage tank by stacking a plurality of unit-wall structures to overlap each other.

In accordance with one aspect, a unit-wall structure for a liquefied gas storage tank on land includes: iron rods arranged lengthwise and breadthwise therein, wherein the unit-wall structure has an arc shape so that a plurality of unit-wall structures are stacked to form a cylindrical wall of the storage tank.

The iron rods may have distal ends protruding from upper, lower, left and right surfaces of the unit-wall structure.

The unit-wall structure may further include a positioning block interposed between the unit-wall structures to locate the unit-wall structures in place when the unit-wall structures are stacked.

The unit-wall structure may further include grooves formed on upper, lower, left and right surfaces thereof to allow the positioning block to be inserted thereinto.

The grooves may concavely extend in lateral and vertical directions on the surfaces of the unit-wall structure.

The iron rods may have distal ends protruding from the upper, lower, left and right surfaces of the unit-wall structure and may be arranged to prevent the distal ends of the iron rods from interfering with the positioning block when the unit-wall structures are stacked with the positioning block interposed therebetween.

The iron rods may have distal ends protruding from upper, lower, left and right surfaces of the unit-wall structure and the positioning block may have a height determined to prevent the distal ends of the iron rods protruding from the surfaces of the unit-wall structures adjacent in the vertical direction from interfering with each other when the unit-wall structures are stacked with the positioning block interposed therebetween.

The iron rods may include a set of iron rods arranged lengthwise and breadthwise inside the unit-wall structure to be assigned to each of front and rear sides of the unit-wall structure.

The iron rods protruding from the surfaces of the unit-wall structure may be connected to protruded iron rods of other unit-wall structure adjacent thereto through an iron rod connecting plate.

Concrete may be cast into a space between the unit-wall structures to prevent the iron rods and the iron rods connecting plate from being exposed after the adjacent unit-wall structures are connected to each other by the iron rod connecting plate, and the iron rod connecting plate may be formed with a plurality of through-holes to allow the cast concrete to flow through the iron rod connecting plate.

The unit-wall structure may further include a frame surrounding the upper, lower, left and right surfaces of the unit-wall structure, a front-side connecting plate disposed on a front side of the unit-wall structure to connect the front side of the unit-wall structure to a front side of another unit-wall structure adjacent thereto, and a rear-side connecting plate disposed on a rear side of the unit-wall structure to connect the rear side of the unit-wall structure to a rear side of another unit-wall structure adjacent thereto.

The unit-wall structure may further include a sealing layer attached to one side thereof.

The positioning block may be divided into upper and lower blocks with a slanted plane interposed therebetween.

In accordance with another aspect, a unit-wall structure for a liquefied gas storage tank on land includes: iron rods arranged lengthwise and breadthwise therein and having distal ends protruding from upper, lower, left and right surfaces of the unit-wall structure.

DETAILED DESCRIPTION OF ILLUSTRATIVE EMBODIMENTS

Embodiments of the present disclosure will now be described in detail with reference to the accompanying drawings.

Figure 1:
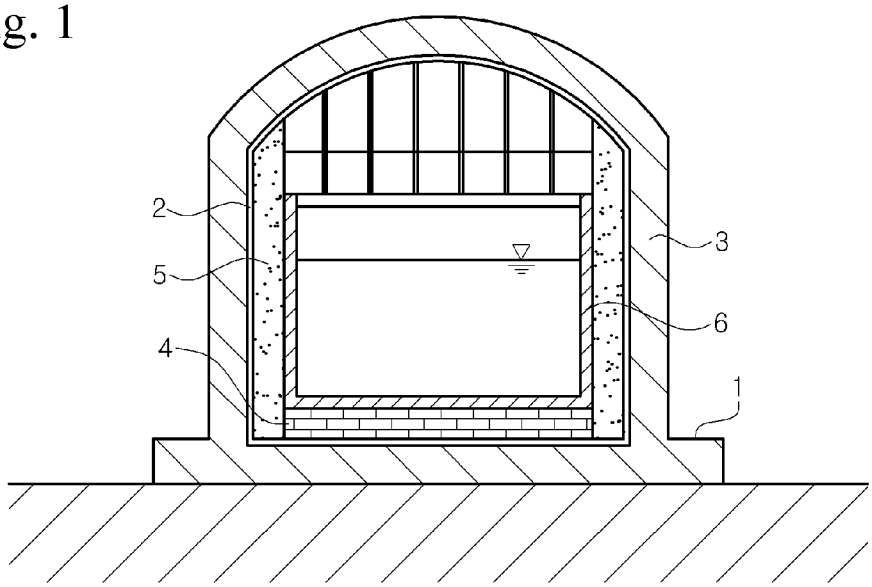
FIG. 1 shows one example of a conventional full-containment type liquefied gas storage tank on land.
Figure 2:
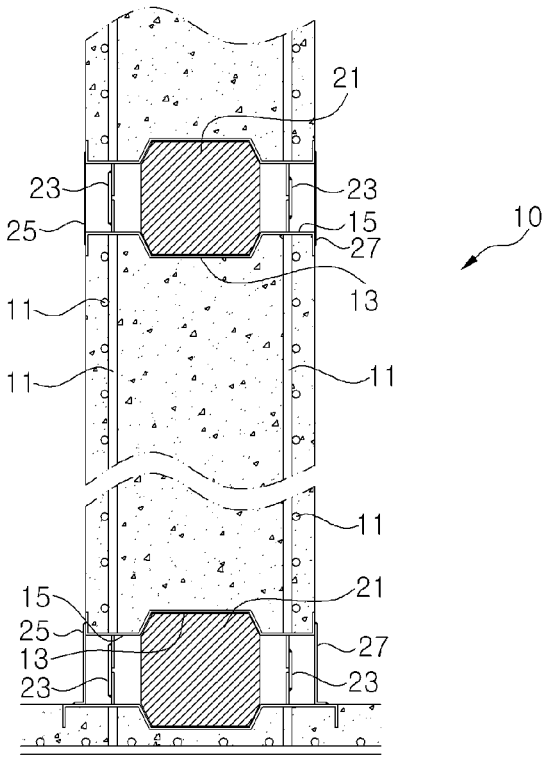
Prior Art Fig. 2
FIG. 2 is a cross-sectional view of a unit-wall structure for a liquefied gas storage tank in accordance with one embodiment of the present disclosure.
Figure 3:
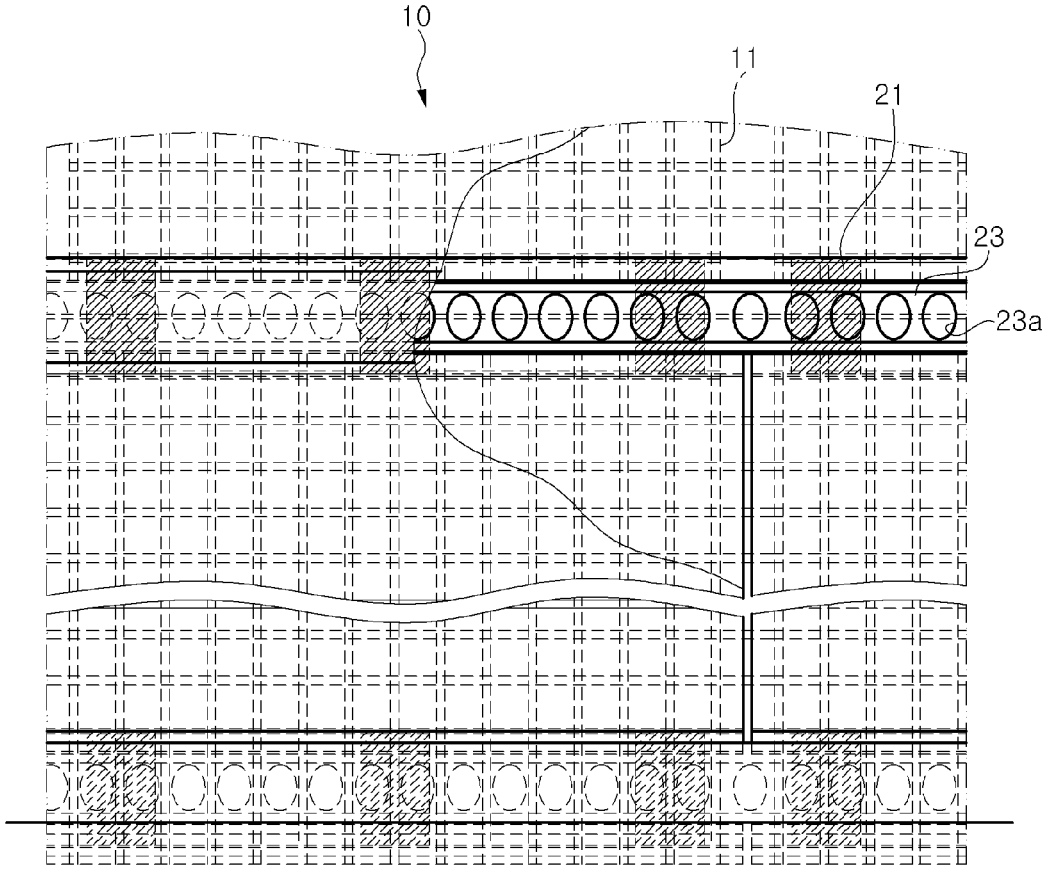
FIG. 3 shows a part of a wall of the liquefied gas storage tank having the unit-wall structures stacked to overlap each other in accordance with the embodiment of the present disclosure.
Figure 4:
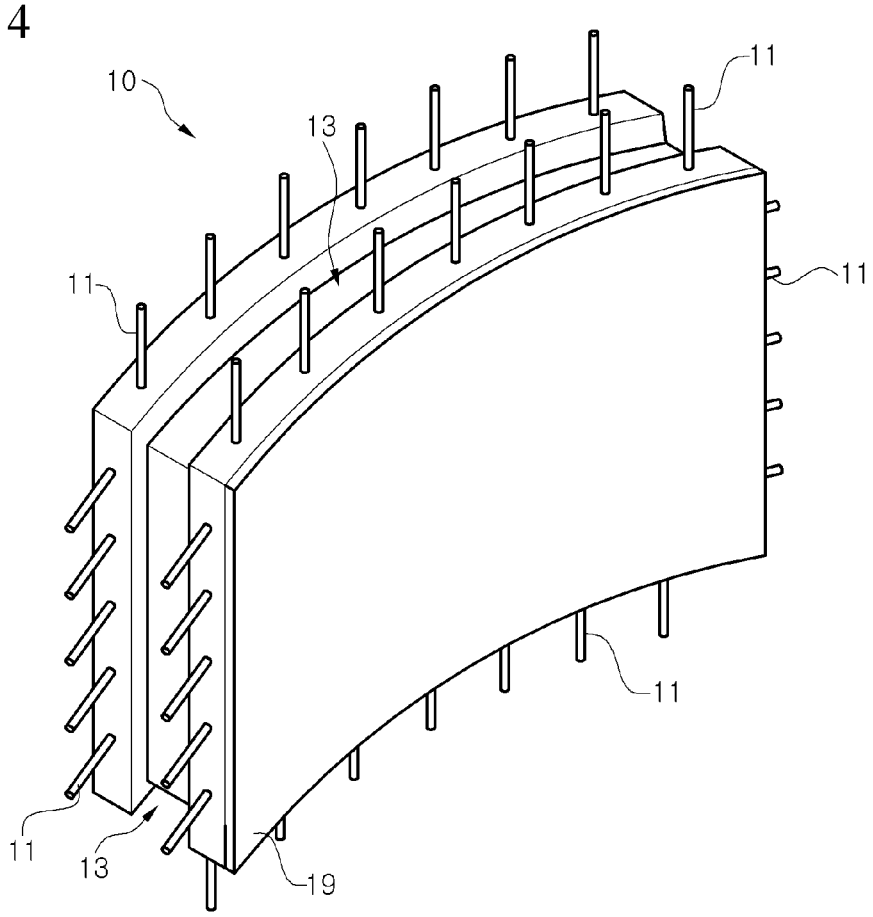
FIG. 4 is a perspective view of the unit-wall structure for the liquefied gas storage tank in accordance with the embodiment of the present disclosure.

Referring to FIGS. 2 to 4, a liquefied gas storage tank on land in accordance with one embodiment is constructed by stacking a plurality of unit-wall structures 10 in an approximately cylindrical arrangement. Each of the unit-wall structures 10 is made of concrete and has a parallelepiped shape wherein iron rods 11 are arranged lengthwise and breadthwise.

Since the storage tank has a cylindrical wall formed by stacking the unit-wall structures 10, each of the unit-wall structures 10 may be rounded to have a substantially arc shape as shown in FIG. 4. Here, since the storage tank has a much greater radius than the width of each of the unit-wall structures, the unit-wall structure will be described as having a substantially parallelepiped shape hereinafter.

Each of the unit-wall structures 10 has grooves 13 on upper, lower, left and right surfaces thereof so that a positioning block 21 is disposed on each of the grooves 13 to stack the unit-wall structures 10 in place. The positioning blocks 21 allow each of the unit-wall structures 10 to be accurately located in place when the unit-wall structures 10 are stacked. Similar to the positioning block 21, a block (not shown) may be interposed between the unit-wall structures 10 adjacent to each other in a lateral direction to align the adjacent unit-wall structures 10 with each other.

In each of the unit-wall structures 10, two sets of iron rods 10 are arranged lengthwise and breadthwise, such that one set of iron rods 10 is assigned to the front side (left side in FIG. 2) of the unit-wall structure 10 and the other set is assigned to the rear side thereof. Distal ends of the iron rods 11 protrude from upper, lower, left and right surfaces of the unit-wall structure 10.

Thus, the distal ends of the iron cores 11 may protrude from the upper, lower, left and right surfaces of the unit-wall structure 10 to be arranged in two rows, as shown in FIG. 4. Particularly, referring to FIGS. 2 and 4, the iron rods 11 protruding from the upper and lower surfaces of the unit-wall structure 10 in the vertical direction may be further biased toward the front side or the rear side of the unit-wall structure 10 than the grooves 13 on which the positioning blocks 21 will be disposed.

The protruded iron rods of the adjacent unit-wall structures may be connected to one another by iron rod connecting plates 23, so that the adjacent unit-wall structures are secured to each other. To connect the iron rods to each other through the iron rod connecting plates 23, for example, welding may be performed.

When stacking the pre-produced unit-wall structures at field sites, it is important to consider continuity (that is, prevention of stress concentration) and constructability (that is, method of connecting the iron rods of the respective unit-wall structures to each other) of the iron rods. In the embodiment, the exposed iron rods of the adjacent unit-wall structures are connected to each other by the iron rod connecting plates 23, thereby satisfying both continuity and constructability of the iron rods.

The iron rod connecting plate 23 may be configured to allow one iron plate to connect the iron rods 11 which are exposed from the unit-wall structures 10 adjacent to each other in the vertical or lateral direction. Alternatively, the iron rod connecting plate 23 may be configured to allow a pair of iron plates, which are attached to each other and joined to other adjacent iron plates by line-welding, to connect only the iron rods 11 to each other at one side of the unit-wall structure.

Here, when the unit-wall structures 10 are stacked with the positioning block 21 interposed therebetween, the height of the positioning block 21 may be determined so as to prevent the distal ends of the iron rods 11 protruding from the surfaces of the unit-wall structures 10 adjacent to each other in the vertical direction from interfering with each other.

Figure 5:
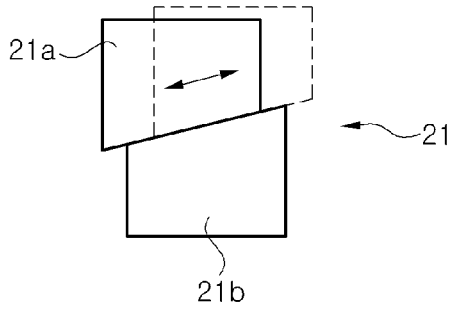
FIG. 5 is a side view of a height-adjustable positioning block.

In order to correct any possible error in a construction site, the positioning block 21 may be divided into upper and lower blocks 21*a* and 21*b* with a slanted plane provided as a border therebetween, as shown in FIG. 5. If the unit-wall structures 10 are stacked in actual construction to a height less than the design, the upper block 21*a* is slightly moved downward (to the left side in FIG. 5) along the slanted plane as indicated by a solid line in FIG. 5 to lower the height of the positioning block 21. On the contrary, if the unit-wall structures 10 are stacked in actual construction to a height greater than the design, the upper block 21*a* is slightly moved upward (to the right side in FIG. 5) along the slanted plane as indicated by a dotted line in FIG. 5 to increase the height of the positioning block 21.

After the adjacent unit-wall structures 10 are connected to each other by the iron rod connecting plates 23, concrete may be cast into a space between the unit-wall structures 10 to prevent the iron rods 11 and the iron rod connecting plates 11 from being exposed. With this configuration, all of the unit-wall structures can be connected to each other to construct the cylindrical wall of the storage tank.

A front side connecting plate 25 and a rear side connecting plate 27 may be provided to front and rear sides of the adjacent unit-wall structures 10 to connect the adjacent front sides to each other and connect the adjacent rear sides to each other, respectively, while serving as moulds for casting concrete.

In order to facilitate installation of the front and rear side connecting plates 25, 27 by welding, the upper, lower, left and right surfaces of the unit-wall structures 10 may be surrounded by a metal frame 15.

Further, the iron rod connecting plate 23 may be formed with a plurality of through-holes 23*a* through which the concrete can be easily cast into the iron rod connecting plate 23.

The iron rod connecting plate 23, the front side connecting plate 25, and the rear side connecting plate 27 can be used not only for connecting the unit-wall structures adjacent to each other in the vertical direction but also for connecting the unit-wall structures adjacent to each other in the lateral direction.

As such, according to the embodiment, all of the unit-wall structures 10 may be integrated to form the integrated cylindrical wall of the storage tank while ensuring sufficient strength by casting the concrete in the space between the adjacent unit-wall structures 10 while connecting the adjacent unit-wall structures to one another in the vertical and lateral directions using the iron rod connecting plate 23, the front side connecting plate 25, and the rear side connecting plate 27.

On the other hand, as shown in FIG. 4, a sealing layer 19, that is, a gas sealing wall acting as a gas barrier, may be attached to the rear side of the unit-wall structure 10, that is, an interior surface of the storage tank, to shield gas leakage. By producing the unit-wall structures with the sealing layers 19 attached thereto, the wall of the storage tank can be advantageously constructed by stacking the unit-wall structures 10 in a cylindrical arrangement and connecting them to one another without separately stacking the sealing layers after constructing the wall of the storage tank.

Next, a method of constructing a liquefied gas storage tank on land in accordance with one embodiment will be described with reference to FIGS. 2 to 4.

In this embodiment, the method may include producing substantially parallelepiped unit-wall structures 10 using concrete, stacking the unit-wall structures 10 in a cylindrical arrangement, and connecting the adjacent unit-wall structures 10 to one another.

As described above, each of the unit-wall structures 10 may be produced by casting concrete into a mould with iron rods 11 arranged lengthwise and breadthwise. Here, the unit-wall structure 10 may have grooves 13 on upper, lower, left and right surfaces thereof, and may be provided with a sealing layer 19 at one side thereof, that is, an inner surface of the completed storage tank.

When stacking the unit-wall structures 10 in the cylindrical arrangement, one or more positioning blocks 21 are disposed on the grooves 13, which are formed on the upper and lower surfaces of the unit-wall structure 10, to be interposed between the unit-wall structures 10 adjacent to each other in the vertical direction. With this configuration, positioning of the unit-wall structures 10 may be securely and conveniently achieved.

Then, exposed iron rods 11 of each unit-wall structure 10 are connected to those of other unit-wall structures 10 adjacent thereto in the vertical and lateral directions through iron rod connecting plates 23. Here, the iron rods 11 and the iron rod connecting plates 23 may be integrally joined by welding or the like.

Further, adjacent front sides of the stacked unit-wall structures 10 are connected to each other by front side connecting plates 25, and adjacent rear sides of the stacked unit-wall structures 10 are connected to each other by rear side connecting plates 27.

Then, concrete is cast into a space between the unit-wall structures 10 adjacent to one another in the vertical and lateral directions, so that the stacked unit-wall structures 10 are completely connected and integrated.

On the other hand, foundation work may be performed on the ground to form a flat foundation before stacking the unit-wall structures 10 in the cylindrical arrangement. Further, after stacking and connecting the unit-wall structures 10 to one another, operation of installing a cover is performed to complete a tank body of the storage tank, and a heat insulating wall and a sealing wall are disposed inside the tank body, thereby completing the liquefied gas storage tank.

When the sealing layer 19 is attached to the unit-wall structure 10 as shown in FIG. 4, the sealing wall may be formed while connecting the stacked unit-wall structures 10 without a separate operation of installing the sealing wall after completing the tank body.

As such, in the method according to the embodiment, the pre-produced unit-wall structures made of concrete are stacked and concrete is then cast into spaces between the unit-wall structures in a construction site, thereby constructing the wall of the storage tank. As a result, the respective unit-wall structures can be more strongly integrated with one another using concrete as a binder of the unit-wall structures while reducing terms for construction of the storage tank.

The unit-wall structure according to the embodiments is pre-producible and enables rapid and easy construction of a cylindrical wall of a liquefied gas storage tank by stacking a plurality of pre-produced unit-wall structures to overlap one another.

Therefore, the unit-wall structure according to the embodiments enables a considerable reduction in time for construction of the liquefied gas storage tank on land, thereby reducing construction costs.

The various embodiments described above can be combined to provide further embodiments. All patents, patent application publications, patent applications, and non-patent publications referred to in this specification and/or listed in the Application Data Sheet are incorporated herein by reference, in their entirety. Aspects of the embodiments can be modified, if necessary, to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed:

1. A liquefied gas storage tank, comprising:

first and second-unit-wall structures, wherein each unit-wall structure includes rods arranged lengthwise and breadthwise therein and a groove arranged at a surface of each unit-wall structure, wherein the rods and the groove are configured such that the groove is free from protrusions by the rods, wherein the unit-wall structures are stacked to form a wall of the storage tank, and wherein a positioning block is interposed between the groove of the first unit-wall structure and the groove of the second unit-wall structure to locate the unit-wall structures in place when the unit-wall structures are stacked.

2. The liquefied gas storage tank according to claim 1, wherein the rods have distal ends protruding from upper, lower, left and right surfaces of the unit-wall structures.

3. The liquefied gas storage tank according to claim 2, further comprising:

grooves formed on left and right surfaces of the unit-wall structures to allow the positioning block to be inserted thereinto.

4. The liquefied gas storage tank according to claim 3, wherein the grooves concavely extend in lateral and vertical directions on the surfaces of the unit-wall structures.

5. The liquefied gas storage tank according to claim 3, wherein the rods have distal ends protruding from the upper, lower, left and right surfaces of the unit-wall structures and are arranged to prevent the distal ends of the rods from interfering with the positioning block.

6. The liquefied gas storage tank according to claim 2, wherein the rods have distal ends protruding from upper, lower, left and right surfaces of the unit-wall structures and the positioning block prevents the distal ends of the rods protruding from the surfaces of the unit-wall structures from interfering with each other.

7. The liquefied gas storage tank according to claim 2, wherein the rods protruding from the surfaces of the first unit-wall structure are connected to protruded rods of the second unit-wall structure through a rod connecting plate.

8. The liquefied gas storage tank according to claim 7, wherein concrete is cast into a space between the unit-wall structures to prevent the rods and the rod connecting plate from being exposed after the adjacent unit-wall structures are connected to each other by the rod connecting plate, and the rod connecting plate is formed with a plurality of through-holes to allow the cast concrete to flow through the rod connecting plate.

9. The liquefied gas storage tank according to claim 2, wherein the positioning block is divided into upper and lower blocks with a slanted plane interposed therebetween.

10. The liquefied gas storage tank according to claim 1, wherein the rods comprise a set of rods arranged lengthwise and breadthwise inside the unit-wall structures to be assigned to each of front and rear sides of the unit-wall structures.

11. The liquefied gas storage tank according to claim 1, further comprising:

a front-side connecting plate disposed on a front side of the first unit-wall structure to connect the front side of the first unit-wall structure to a front side of another unit-wall structure adjacent thereto; and a rear-side connecting plate disposed on a rear side of the unit-wall structure to connect the rear side of the unit-wall structure to a rear side of another unit-wall structure adjacent thereto.

12. The liquefied gas storage tank according to claim 1, further comprising: a sealing layer attached to one side of at least one of the unit-wall structures.

13. The liquefied gas storage tank according to claim 1, wherein the rods have distal ends protruding from the surfaces of the unit-wall structures and are arranged to prevent the distal ends of the rods from interfering with the positioning block when the positioning block is interposed at any position between the groove of the first unit-wall structure and the groove of the second unit-wall structure to locate the unit-wall structures in place when the unit-wall structures are stacked.

14. The liquefied gas storage tank according to claim 1, wherein each wall-unit structure further comprises an inner wall structure and an outer wall structure, wherein the rods within each wall-unit structure are arranged such that a set of rods from the rods is arranged lengthwise and breadthwise in the inner wall structure and the remaining set of rods from the rods is arranged lengthwise and breadthwise in the outer wall structure, and wherein the inner wall structure and the outer wall structure are connected together to form the groove at the surface of the wall-unit structure.

15. The liquefied gas storage tank according to claim 1, wherein the rods are configured such that the positioning block is free from protrusions by the rods.

16. The liquefied gas storage tank according to claim 1, wherein the unit-wall structures are stacked such that at least one rod from the rods of the first unit-wall structure is configured to be connected to at least one rod from the rods of the second unit-wall structure.

* * * * *